United States Patent [19]

Bosgiraud et al.

[11] Patent Number: 4,941,776

[45] Date of Patent: Jul. 17, 1990

[54] CATENARY ANCHORAGE LINE FOR A FLOATING VEHICLE AND DEVICE AND METHOD FOR USING THIS ANCHORAGE LINE

[75] Inventors: Jean-Michel Bosgiraud, Paris; Andre Cendre, Cosne Sur Loire, both of France

[73] Assignees: Seamet International, Paris; S.M.F. International, Cosne Sur Loire, both of France

[21] Appl. No.: 243,266

[22] Filed: Sep. 12, 1988

[30] Foreign Application Priority Data

Sep. 10, 1987 [FR] France ..... 87 12565

[51] Int. Cl.[5] ..... B63B 21/38

[52] U.S. Cl. ..... 405/224; 405/195; 114/293; 114/294

[58] Field of Search ..... 405/167, 195, 224; 114/293, 294

[56] References Cited

U.S. PATENT DOCUMENTS

| | | | |
|---|---|---|---|
| 3,295,489 | 1/1967 | Bossa | 114/294 |
| 3,394,672 | 7/1968 | Ledgerwood | 114/294 |
| 3,756,034 | 9/1973 | Lochridge et al. | 405/167 |
| 4,031,919 | 6/1977 | Ortloff et al. | 405/224 X |
| 4,094,161 | 6/1978 | Moinard et al. | 405/224 X |
| 4,468,157 | 8/1984 | Horton | 405/224 |
| 4,470,724 | 9/1984 | Pollack | 405/224 X |

FOREIGN PATENT DOCUMENTS

| | | | |
|---|---|---|---|
| 1565613 | 3/1968 | France | 114/294 |

*Primary Examiner*—Dennis L. Taylor
*Assistant Examiner*—Arlen L. Olsen
*Attorney, Agent, or Firm*—Antonelli, Terry, Stout & Kraus

[57] ABSTRACT

An anchorage line comprising a large number of successive elements interconnected in an articulated way and each including a closed watertight tube delimitating an interior volume full of air. The anchorage line comprises a shallow depth extremity providing the link with a floating vehicle and a very deep anchorage extremity providing anchorage on an ocean bottom. The floatability of the anchorage line varies according to its length. The tubular essential parts of the anchorage line have a wall thickness related to their diameter and which is thicker the nearer these parts are to the anchorage extremity of the line. The anchorage line may be assembled on site and put in place by a suitable device.

11 Claims, 5 Drawing Sheets

20
24
26
21
25
22
29
28
30
27
5
32
32
23
32a
32b
23
33
33
34
36
35
26
30
27

θ
FV
FH
F

CATENARY ANCHORAGE LINE FOR A FLOATING VEHICLE AND DEVICE AND METHOD FOR USING THIS ANCHORAGE LINE

FIELD OF THE INVENTION

The invention concerns a catenary anchorage line for a floating vehicle, or unit especially a very deep line allowing anchoring at a depth of over 300 meters as well as a device and a method for assembling and installation of the catenary anchorage line.

BACKGROUND OF THE INVENTION

The floating unit used for the research and exploitation of underwater hydrocarbons require the use of anchorage lines whose extremity is integral with a sea anchor or fixed to a pile, so as to keep these lines in place and stop forces causing them to drift, for example, forces provoked by wind or oceanic currents.

The need to exploit oil deposits at increasingly larger and larger depths requires the use of extremely long lines joining the bottom to the surface.

As regards the anchorage of oil platforms, buoys or storage oil tanks, it may be necessary to install anchorage lines to extremely large water depths of, for example, about from 300 to 1000 meters.

It is common practice to produce an anchorage line in the form of a chain, for example, with welded chain-links. However, in the case of a very long line, for example, a line longer than 3000 meters, the weight of the chain is too heavy in relation to the haulage capacity of this chain.

In effect, a large part of the solidity of the chain is then devolved upon supporting the chain itself and not upon holding the floating vehicle.

Producing an anchorage line in the form of a cable is more appropriate for extremely long anchorage lines due to the cable's high capacity of resistance to traction and a linear weight (with equal resistance) being less than the chain. However, where extremely large lengths are required, it is difficult and often impossible to produce and use a cable as an anchorage line. In particular, the storage and handling of very large lengths of large diameter cables causes problems which are very difficult to resolve.

It has been proposed to use tubular elements with closed extremities and interconnected in an articulated way so as to constitute very long anchorage lines. Each of the essential parts or constituent elements of the line, which is closed at its extremities or ends, so as to be watertight, delimits an interior volume full of air and thus constitutes a float capable of counterbalancing, via the buoyancy in the water, all or part of the weight of the element. Up until now, such anchorage lines have been used as taut lines, namely lines which are in a virtually rectilinear position when in use.

The horizontal pull-back forces or restoring forces of the floating vehicle, when this vehicle tends to go adrift when exposed to the wind and under the effect of oceanic currents, are due to either solely to the elasticity of the line, or to a traction device connected to the anchorage line end situated opposite in relation to the drift or leeway of the vehicle.

When such taut anchorage lines are used, which operate in the same way as bracings, it is obviously advantageous to reduce the apparent weight of the anchorage line when the anchorage line is submerged in the water. It can be particularly advantageous to calculate the essential parts of the anchorage line so as to reduce its apparent weight in the water to approximately nil.

In the case of catenary anchorage lines, namely, anchorage lines assuming a small chain curved form when in service, the problem is completely different, as the horizontal restoring force of the floating vehicle corresponds to the horizontal projection of the line stress at the point linking the anchorage line and the floating vehicle. The stress in the anchorage line depends on the apparent weight of the anchorage line in the water when the horizontal component of the stress at the anchorage point is particularly large in relation to the vertical component when the anchorage line is closer to horizontal at this point.

The lightened anchorage lines known from the prior technique would not make it possible to obtain significant horizontal restoring forces and would not be able to produce highly efficient catenary anchorage lines.

However, in the case of long anchorage lines, lightening under the effect of buoyancy is a considerable advantage to the extent that the actual weight of the entire anchorage line can be significantly reduced.

SUMMARY OF THE INVENTION

It is therefore the aim of this invention to propose a catenary anchorage line for a floating vehicle constituted by a large number of successive elements interconnected in an articulated way, with each element being constituted by a watertight tube closed at both of its extremities and delimiting an interior volume filled with air, the line comprising a shallow depth extremity linking the floating vehicle to a large depth anchorage extremity providing anchorage on the sea bottom, and with the anchorage line offering considerable efficiency and being extremely flexible in use.

With this aim in mind, the floatability of the anchorage line varies depending on its length, the tubular essential parts generally having a wall thickness related to their diameter and which is thicker when they are near to the line anchorage extremity.

BRIEF DESCRIPTION OF THE DRAWINGS

The above and other objects, features, and advantages of the present invention will become more apparent from the following description when taken in connection with the accompanying drawing which show, for the purpose of illustration only, several embodiments of an anchorage line in accordance with the present invention, and wherein.

DETAILED DESCRIPTION OF THE PREFERRED EMBODIMENTS

Figure 1:
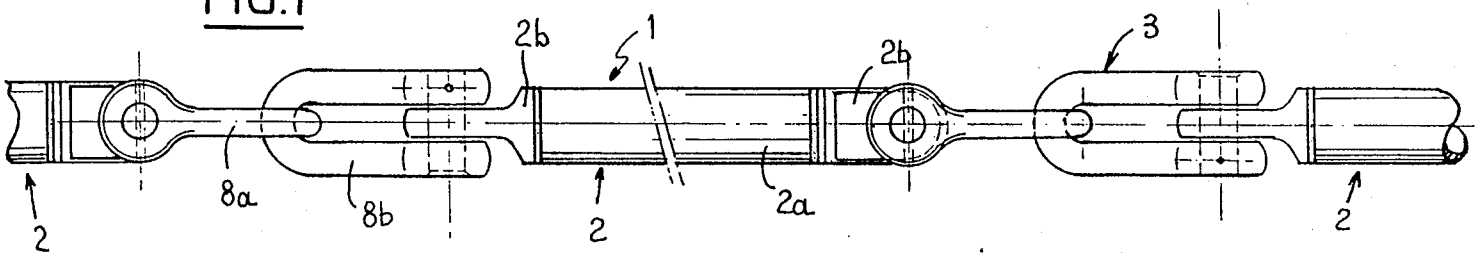
FIG. 1 is a side view of an anchorage line constructed in accordance with the present invention.
Figure 2:
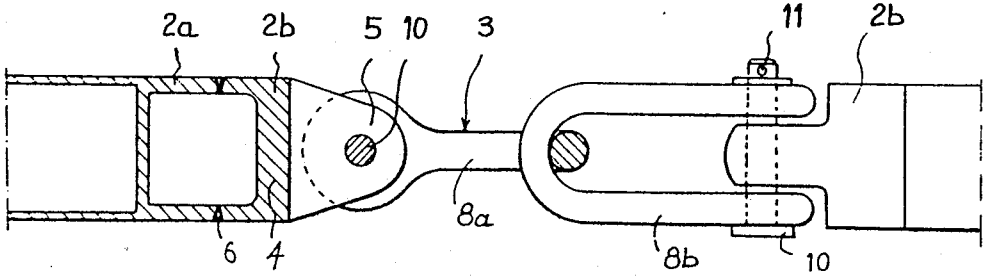
FIG. 2 is a partial cross-sectional side view of a joint for linking two successive elements of the anchorage line of FIG. 1.

Referring now to the drawings wherein like reference numerals are used throughout the various views to designate like parts and, more particularly, to FIGS. 1 and 2, according to these figures, an anchorage line generally designated by the reference numeral 1, in an articulated form, comprises successive segments generally designated by the reference numeral 2 and are connected by joints generally designated by the reference numeral 3. Each segment 2 includes a tube 2*a* closed at each of its extremities by a linkage and closing part 2*b* fashioned as forged parts comprising a solid bottom 4 for locking the tube 2*a* and a linkage protuberance 5. The solid bottom 4 comprises a cylindrical flange with a diameter equal to or larger than a diameter of a standard portion of the tube 2*a* and which is welded, for example, by friction welding, to the extremity of the tube 2*a* next to a connection zone generally designated by the reference numeral 6. The extremity of the tube 2*a* where the connection is effected is thicker than a standard thickness of the tube 2*a*.

Each of the tubes 2*a*, closed at its two extremities by the solid bottoms 4 of the parts 2*b*, delimits an interior volume filled with air, totally sealed from the outer environment. Each of the segments or elements 2 of the anchorage line 1 possess considerable buoyancy when immersed in a liquid such as, for example, sea water.

Figure 3:
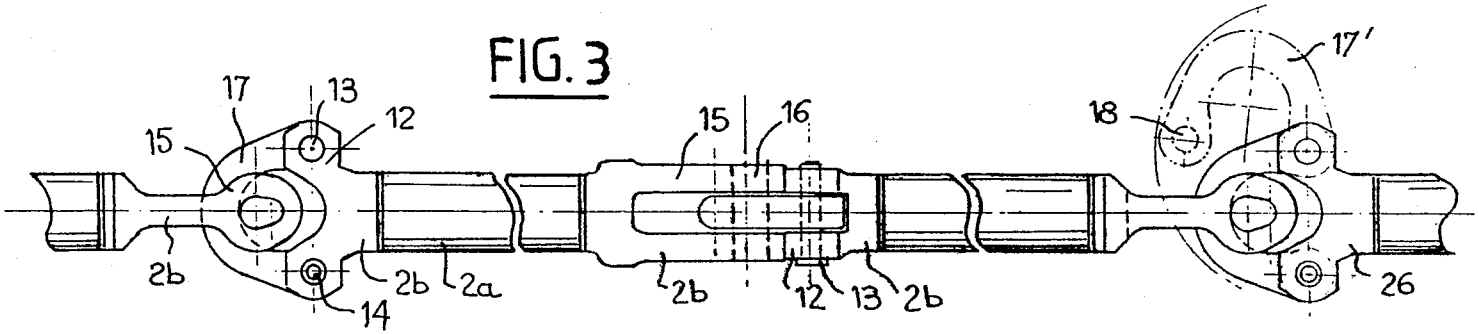
FIG. 3 is a side view of an anchorage line portion in accordance with another embodiment of the present invention.

The two embodiments of the anchorage line one in FIGS. 2 and 3 only differ by the constitution of the articulated linking device 3 between the successive segments 2.

In FIG. 2, the joint or articulated linking device 3 is constituted by two load shackles 8*a* and 8*b* engaged into each other and each connected to the linking extremity 2*b* of the tube 2*a* so as to articulatingly connect two successive tubes 2*a* to each other. Each of the load shackles 8*a*, 8*b* is connected to the corresponding protruberance 5 by a spindle 10 engaged into aligned openings of the protruberances 5 integrally formed with the extremities of the two branches of the load shackle 8*a*, 8*b*. The successive protruberances 5 are disposed in a 90° relationship with respect to each other. After assembly, the spindle 10 is fixed via a pin 11.

As shown in FIG. 3, for each of the segments or elements 2, one of the closing parts 2*b* constitutes a double fork-joint 12 in which a hinge pin 13 is fixed and which comprises, in a position symetrical in relation to a center axis of the anchorage line 1 and in a direction parallel to the hinge pin 13, a hole 14, plain in one part of the fork-joint 12 and tapped in the other part.

The other closing part 2*b* of each segment or element 2 is in the form of a fork-joint 15 between the branches of which a spindle 16 is secured.

A limit stop 17 is mounted articulated onto the hinge pin 13 of the double fork-joint 12 via one of its extremities and comprises a hole 18 at its other extremity.

The limit stop 17 may be placed in an open position 17′ (shown by the dot-and-dash lines) by tilting outwards. In this position, the fork-joint 15 and the spindle 16 of a part 2*b* of a first segment or element 2 may be placed in an assembly position close to the fork-joint 12 of a closing part 2*b* of a second segment or element 2 to be assembled.

The limit stop 17 is then folded down into its closing position (shown by the full lines) around the spindle 16 and so that the branch of the limit stop 17 comprising the opening 18 comes into engagement into the part of the forked-joint 12 comprising the tapped hole 14.

In the above described embodiments, the joint or linking device 3 acts as a universal joint and allows for any relative orientation of the two successive tubes 2*a*. Moreover, the two tubes 2*a* have a relative axial displacement latitude which may be relatively significant where linking is effected by load shackles.

In the two embodiments, the assembling and linkage of the two successive tubes 2*a* may be effected very easily and quickly.

In the case of an anchorage line used for drilling or oil exploitation at sea and at great depths, the tubes 2*a* could be steel tubes of about 9 to 12 meters in length.

These steel tubes 2*a* could be made of drillstems, drill collars, casing elements or any other steel tubular element currently used in oil techniques and available from tube manufacturers.

It is quite apparent that, by varying the ratio between the diameter and wall thickness of the tube 2*a*, it is possible to obtain compensation of the weight of the tube 2*a* via the buoyancy in a determined proportion. According to the invention and as explained subsequently, the anchorage line 1 presents variable buoyancy according to its length, its essential parts not all being identical and having variable wall thicknesses to diameter ratio.

Generally, the essential parts placed at a greater depth shall have a wall thickness which is larger than a wall thickness of the segments or elements placed at a shallower depth.

Figures 4, 5, 6:
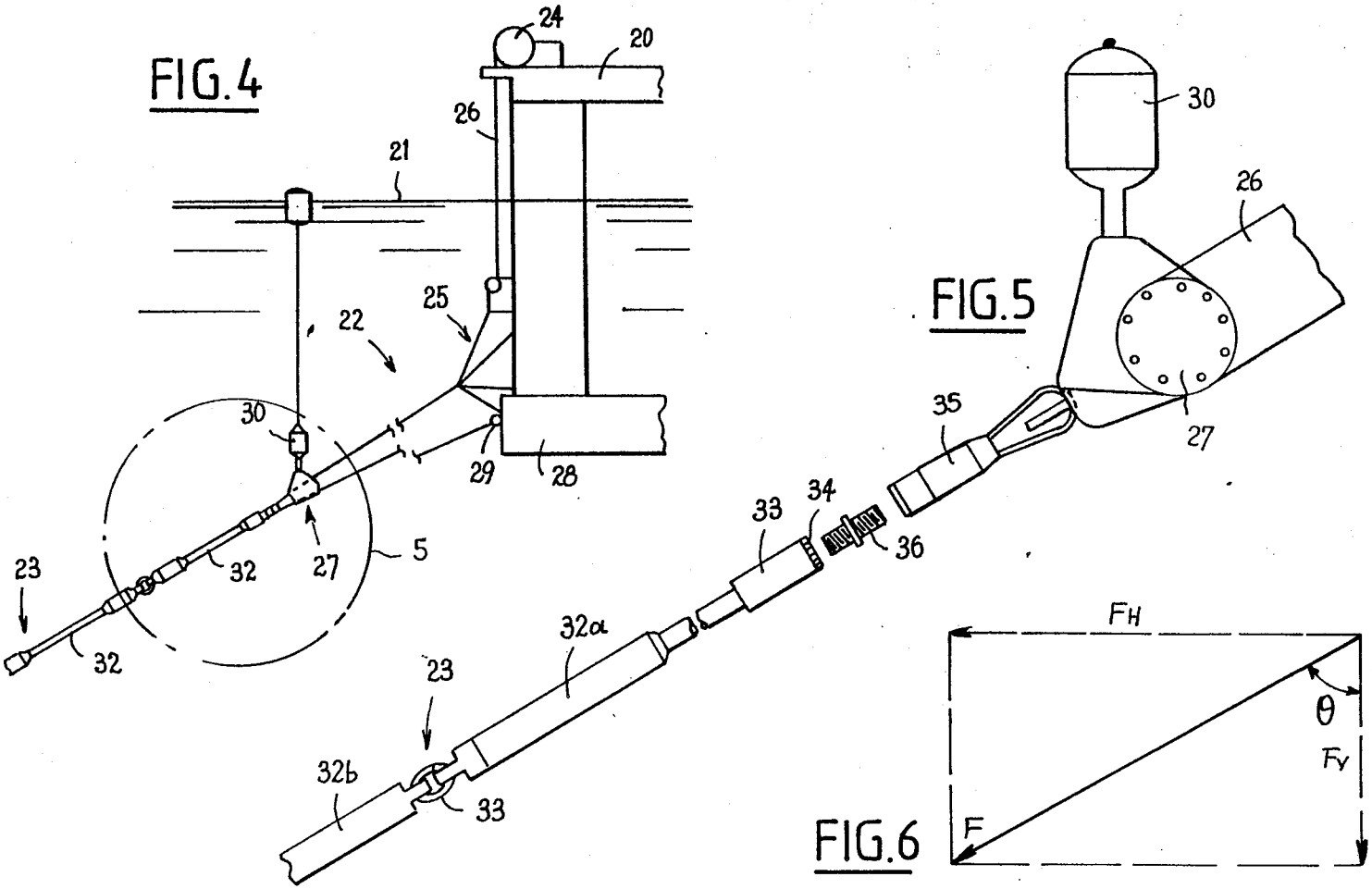
FIG. 4 is a schematic front view of a shallow depth extremity of an anchorage line of the present invention linked with a semi-submersible drilling platform.
FIG. 5 is an enlarged view of a detail of FIG. 4.
FIG. 6 is a diagrammatic illustration of a resolution of a force exerted in the anchorage line of FIGS. 4 and 5 at a point linking the anchorage line with the platform.

As shown in FIG. 4, one part of a semi-submergible drilling platform, partially immersed under the level 21 of the sea, is linked by a shallow depth part generally designated by the reference numeral 22 of an anchorage line generally designated by the reference numeral 23 some meters below the level 21 of the sea.

The drilling platform 20 bears on its upper part a winch 24 connected to a traction cable 26 and, in its immersed part, a fairlead generally designated by the reference numeral 25 ensuring the guidance and sending of the cable 26 towards an immersed mobile piece of tackle generally designated by the reference numeral 27 connected to the extremity of the anchorage line 23. The tackle 27 ensures sending of the cable 26 towards an anchorage part 29 secured to the lower immersed part or hulk 28 of the platform 20.

The tackle 27 is maintained in a suitable orientation by flotation equipment 30 which can be connected to a surface buoy allowing the tackle 27 to be marked.

As shown in FIG. 5, the final tubular element 32*a* of the anchorage line 23 comprises a tubular extremity part 33 closed internally by a threaded part 34. An element 35 connected in an articulated way to the tackle 27 also comprises a tapped extremity part.

A connection part 36 comprising two threaded extremity part allows for the parts 33 and the element 35 to be assembled and thus the line anchorage 23 and the tackle 27 are both connected to the platform 20 via the traction cable 26. The threaded sections of the connection part 36 are threaded into the tapped threaded part 34 and the element 35 to provide the assembly. Tensioning of the anchorage line 23 is insured by the winch 24 by the cable 26 and the tackle 27.

The tubular element 32*a* is connected to a standard tubular element 32*b* of the anchorage line 23 via an articulation device 33, as shown in FIG. 5.

The tubular elements 32 of the anchorage line 23 are similarly constituted as the tubular segments or elements 2 in FIGS. 1 to 3.

These segments or elements 32 constitute flotation items of equipment and at least partially compensate their weight via buoyancy when they are immersed in the water. This compensation may vary depending on the ratio of the total volume of the tubular segment or element 32 corresponding to the volume of displaced water and the volume of the steel mass of the tubular segment or element 32, namely, in fact to the value of the ratio of the wall thickness of the tubular segment or element 32 to the outer diameter of the segment or element 32. Thus, it is possible to use tubular segments or elements 32 with a specific buoyancy in order to constitute the different parts of the anchorage line 1 or 23.

In FIG. 6, the force or tension F is the force or tension in the anchorage line 23 at the point linking this anchorage line to the platform 20, namely, to the extremity of the anchorage line 23 connected to the tackle 27. The force or tension F includes a horizontal restoring force component $F_H$ and vertical component of the force $F_V$, with the vertical component $F_V$ forming an angle $\theta$ with the direction of the force F, namely, the direction of the anchorage line 23 at its linkage point.

The effective restoring force of the platform 20 is constituted by the horizontal force $F_H$ of the force F. The vertical component $F_V$ is a parasitic force since this variable load is exerted at the expense of the stability of the floating equipment, namely, the drilling platform 20.

It is therefore desirable to make the vertical component $F_V$ as small as possible, namely, for a given force F, to have an angle $\theta$ as large as possible. This result may be obtained by using the lightened tubular segments or elements in order to constitute the shallow depth part 22 of the anchorage line 23.

In order that the restoring force $F_H$ be significant, the axial load F also needs to be significant.

An anchorage line 23 lightened uniformly over its entire length would not enable this result to be obtained, since the total apparent weight of the anchorage line 23 in the water would be light where a catenary anchorage is involved, namely, an anchorage whose line has a significant curve and furnishes a restoring force depending on it apparent weight in the water.

The anchorage line 23 of the present invention presents variable buoyancy according to its length, with the tubular segments or elements being situated at a shallower depth generally having a smaller wall thickness than the tubular segments or elements situated at a greater depth. This concept makes it possible to reconcile the contradictory essential requirements mentioned above, since the highly lightened upper tubular segments or elements 32 enable the angle $\theta$ to be increased at the linkage point and where the lower tubular segments or elements situated at a greater depth having an apparent weight in high water enable the force F to be increased adequately so as to obtain a satisfactory restoring force component $F_H$.

Moreover, where anchorage occurs at a great depth, the essential parts having a thick wall at the lower part of the anchorage line 23 enable the pressure resistance of the anchorage line 23 to be increased.

With the anchorage line 23 being lightened due to the presence of the tubular segments or elements 32, it shall be possible to use a very long anchorage line 23, which makes it possible to reduce the average inclination of the anchorage line 23 in relation to the horizontal plane and increase the restoring force component $F_H$.

Figure 7:
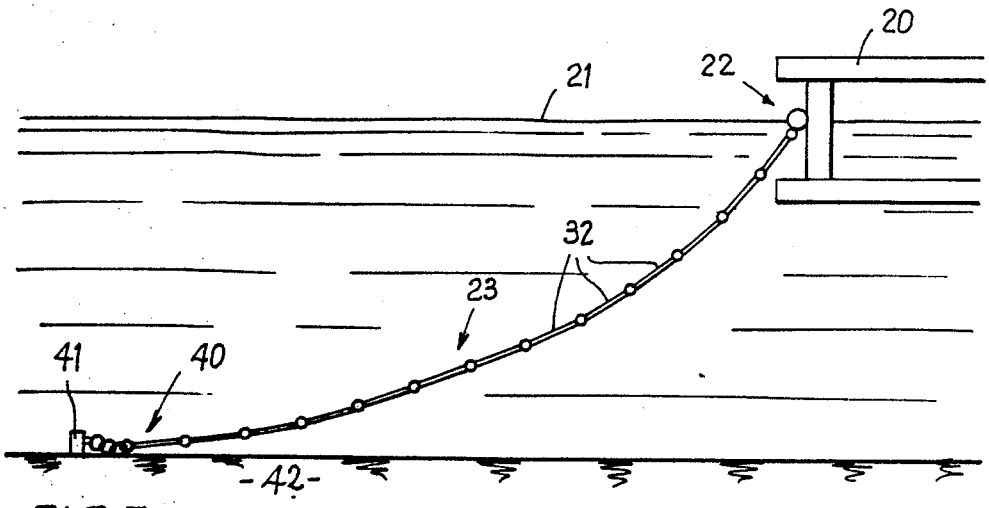
FIG. 7 is a schematic view of the form assumed in use by an anchorage line of the first embodiment of the present invention.
Figure 8:
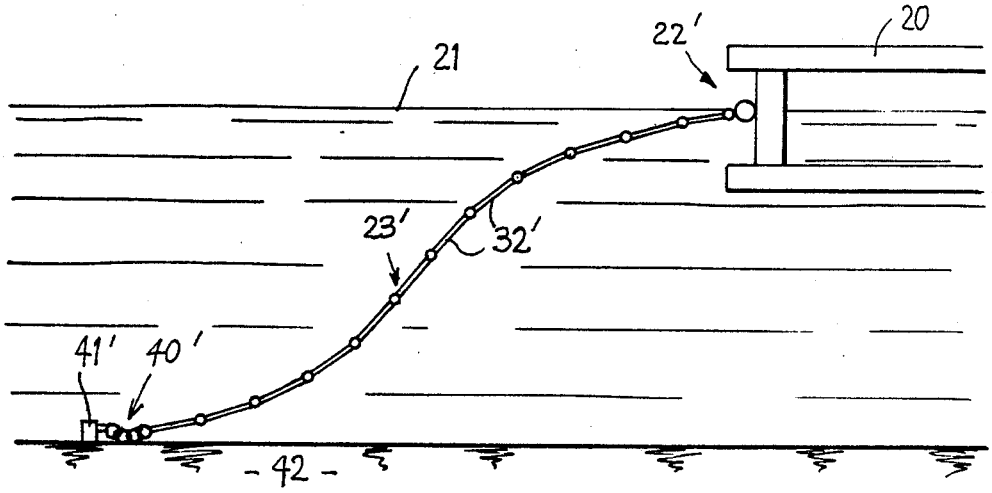
FIG. 8 is a diagrammatic view of a form assumed in use by an anchorage line of the second embodiment of the present invention.

As shown in FIGS. 7 and 8, an anchorage line 23 or 23' insures the anchorage of a semi-immersed platform 20 under the surface 21 of the sea. The anchorage line 23 or 23' is connected via its upper shallow depth extremity 22 or 22' to the platform 20 and via its lower extremity generally designated by the reference numeral 40 or 40' to a drill-foundation pile 41 or 41' secured to the bottom 42 of the sea.

By adjusting the buoyancy of the various parts of the anchorage line 23 or 23' along its length between its extremity 40 and its extremity 22 or 40' and 22', it is possible to obtain different forms of this anchorage line 23 or 23' when it is immersed.

This adjustment of the buoyancy of the anchorage line 23 or 23' is obtained by varying the wall thickness/-diameter ratio of the essential tubular segments or elements 32 or 32' of the anchorage line 23 or 23' from its extremity 40' up to its extremity 22 or 22'.

Generally speaking, the essential tubular elements or segments 32 situated close to the extremity 40 or 40' shall have a wall thickness greater a wall thickness of the tubular segment or elements 32 or 32' situated close to the extremity 22 or 22'.

As shall be explained later concerning the above-described embodiment, the anchorage lines 23 or 23' shall generally be constituted from successive sections comprising identical tubular segments or elements 32, 32' with these segments or elements 32, 32' having an buoyancy increasing from the bottom up to the surface.

The anchorage line 23 shown in FIG. 7 has the form of a catenary curve whose curvature continuously varies. This form is obtained with an anchorage line 23 comprising successive tubular elements or segments 32 whose buoyancy increases continually from the bottom up to the surface.

The anchorage line 23' shown in FIG. 8 has a complex form shaped like an S at two bending points. This anchorage line 23' comprises large depth section whose weight in deep water is of the same order of magnitude as the weight out of water, shallow depth section 22' having a very light apparent weight in water and an intermediate part consisting of relatively short section whose buoyancy increases quickly.

The profile shown in FIG. 8 makes it possible to reduce the length of the anchorage line 23' to be deployed and thus the costs of embodiment and of installing the anchorage line 23'.

Next, a description follows of examples of a tubular catenary line as described hereinabove allowing for the anchorage of a semi-submersible drilling platform 20 at 600 meters deep (first example) and at 1000 meters deep (second example).

In both examples, the floating equipment constituted by the semi-submersible drilling platform 20 is subjected to external forces due to the wind, currents and swell which contribute in causing the drilling platform 20 to move relative to the surface of the sea. So as to reduce the horizontal displacement of this floating drilling platform 20 in any direction, an anchorage device is used which comprises ten catenary lines and regularly distributed around the floating drilling platform 20, namely, spaced angularly 36° in relation to each other.

In each of the examples, the performances of the catenary anchorage line of the invention shall be compared with the performances of a conventional line partly constituted by a chain and partly by a cable having the same rupture strength.

In both examples, the horizontal displacement of the floating drilling platform 20 shall be limited to 6% of the anchoring depth.

EXAMPLE 1

Anchorage per 600 meters deep

The maximum authorized displacement of the floating drilling platform 20 is 36 meters in any direction.

A conventional platform anchorage device would include eight anchorage lines each constituted per 1500 meters of cable and 1500 meters of a chain with a diameter of 3" (inches). Each of the anchorage lines would supposedly be at 600 KN in order to support the external forces in operation.

In such a configuration, the maximum horizontal tension attained in operation in an anchorage line is 1266 KN and the associated vertical tension is 650 KN, with the angle of the fairlead being 27.2° in relation to horizontal. The vertical force exerted on the floating drilling platform 20 by the eight anchorage lines is thus close to 5200 KN.

An articulated tubular anchorage of the invention allowing for anchorage per 600 meters deep of the drilling platform 20 and the recall of the drilling platform 20 in the given conditions shall be constituted by eight tubular chain link anchorage lines with an outer diameter of 10¾ inches and an apparent weight increasing with the depth of immersion. Each anchorage line with a length equal to 4000 meters shall consist of three sections with the respective length specified hereafter. Each section shall consist of tubular elements with an apparent weight in the given water, namely, a constant wall thickness outer diameter ratio. The apparent weight in the water of the different sections diminishes from the bottom towards the surface, as indicated in the following table:

| | Section | | |
|---|---|---|---|
| | 1st | 2nd | 3rd |
| Apparent linear weight in water: | 1011 N | 94 N | −59 N |
| Weight in corresponding air: | 1210 N | 811 N | 870 N |
| Length | 700 m | 3000 m | 300 m |

For the same external stresses imposed on the floating drilling platform 20 as those indicated in the case of a conventional type of catenary anchorage line and the same initial pre-tension stresses, the maximum horizontal tension reached in an anchorage line when operating is 1887 KN and the vertical tension is 442 KN, the angle at the fairlead 25 then being 13.2° in relation to horizontal.

The vertical force exerted on the floating equipment is thus close to 3536 KN. This value is to be compared to the vertical force of 5200 KN exerted by the standard conventional anchorage line on the drilling platform 20. The difference between these two values, namely, 1664 KN, enables either the variable carrying capacities aboard the floating drilling platform 20 to be increased or to reduce the stability reserve of the floating drilling platform 20 and thus its cost.

EXAMPLE 2

Anchorage per 1000 meters deep

The maximum authorized horizontal displacement is 60 meters in any direction. Anchorage is constituted as previously by eight anchorage lines regularly distributed around the drilling platform 20.

In the case of a conventionally designed line with 1500 meters of cable and 1050 meters of chain with a diameter of 3¾" (inches), the maximum vertical tension attained in operation is 1297 KN for an angle at the fairlead 25 of 31.7° in relation to horizontal. The maximum vertical force exerted on the floating equipment by such an anchorage device is thus about 10376 KN.

This conventionally designed line shall be compared to a line with tubular chain links and 5,300 meters long made up of four sections with the respective lengths specified hereafter. The apparent weight in water of the sections increases with the depth involved, as specified in the table below:

| | Section | | | |
|---|---|---|---|---|
| | 1st | 2nd | 3rd | 4th |
| Apparent linear weight in water | +1010 KN | 230 KN | 94 KN | −58 KN |
| Weight in corresponding air: | 1210 KN | 830 KN | 811 KN | 870 KN |
| Length (m): | 500 | 4000 | 500 | 300 |

The maximum vertical tension attained in a line is 808 KN with an angle at the fairlead 25 of 23.2° in relation to horizontal. The maximum vertical force exerted on the floating drilling platform 20 by such an anchorage device is about 6470 KN. This value is to be compared to the value of 10,376 KN obtained where a conventional device is used. It is thus possible to obtain a reduction of the vertical force of 3906 KN, which allows advantages to be gained, such as those mentioned above where anchoring occurs per 600 meters deep.

In all cases, the tubular anchorage line of the invention may consist entirely of standard elements, each obtained by welding identical forged pieces at the extremity of tube sections with a desired outer diameter and wall thickness.

The articulated connection devices between the line elements could either be specially made or constituted of standard elements commercially available. The production of the anchorage line may thus be limited to the embodiment of forged extremity parts and to their end-to-end welding to the extremities of tubes, for example, by of friction. These operations can easily be automated.

The steel of the tubes used in oil technology may have a breaking strength of about 1000 MPa; this resistance may be compared favorably with the resistance of chain steels and which never exceeds 900 MPa.

On the other hand, the cables consist of steel wires whose resistance may reach 1900 MPa after treatment.

However, the lightening due to the buoyancy of the anchorage line of the invention at the time it is used enables performances to be obtained and which are far superior to those of the best currently known anchorage cables.

Moreover and as shall be explained below, the anchorage line of the invention may be readily deployed and used by virtue of its modular structure.

Figure 9:
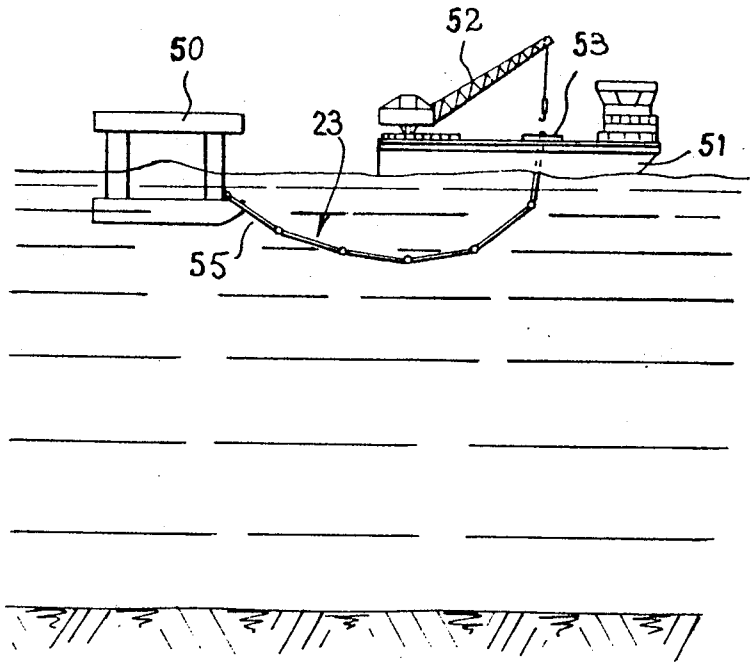

FIG. 9 shows a first mode for using and implementing an anchorage line 23 where it is desired to embody the anchorage of a semi-submersible platform 50 on the sea bottom.

A barge 51 equipped with a crane 52 is brought close to the semi-submersible platform 50. Onto the barge 51 is loaded all the elements required to constitute the anchorage line 23 of the platform. These elements may include several tens of tubular segments or elements, such as the elements 2 or 32, and several tens of articulated linking devices, such as the devices 3 or 33. At the mounting or assembling installation 53, for example, a casing table, and of the crane 52, the assembling is carried out of the anchorage line sections, each including of a tubular element 32 in order to obtain a certain length of the anchorage line 23. The first segment 55 of the anchorage line is connected to the platform 50 by normal means.

Assembling the anchorage line 23 from the barge 51 continues until the moment this anchorage line reaches a sufficient length. Then the extremity of the anchorage line 23 obtained is equipped with a marine anchor which is then immersed where the last extremity of the anchorage line 23 is connected to a drill-foundation pile by a technically known suitable item of equipment.

The assembling and deployment of the anchorage line 23 are effected by means of the crane 52 and the assembling installation 53 according to a known technique so as to establish a train of drilling rods or a casing. The assembling installation 53 may include any drilling rod assembling table or any casing table.

It is also quite clear that other means currently used in drilling techniques or in laying pipelines could be used. Such means may include elevator winches, slips or various tube stacking devices.

It would be an advantage for the barge 51 to be a handling barge or pipeline laying barge or a drilling platform provisioning barge allowing for the transportation and supply of heavy packages.

Figure 10:
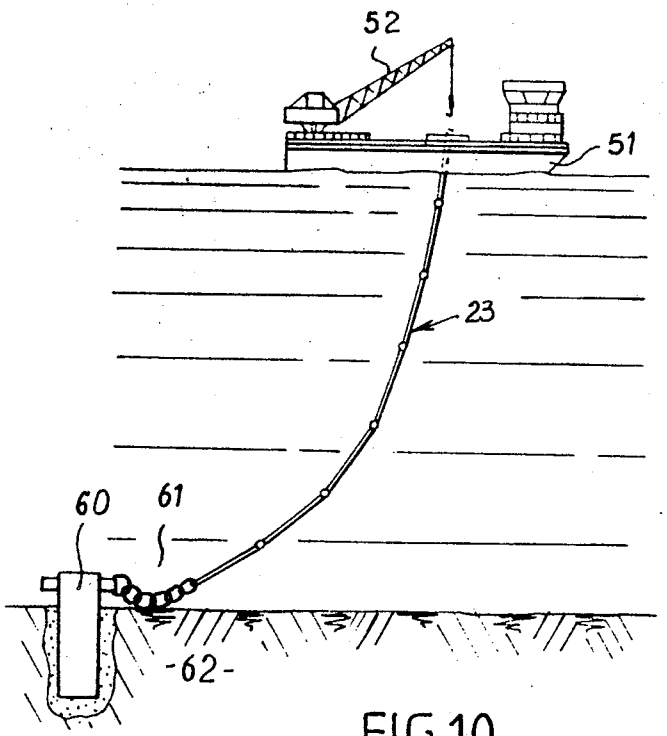
FIGS. 9–12 are schematic views respectively illustrating various modes for implementing and using an anchorage line constructed in accordance with the present invention.

FIG. 10 shows a second mode for implementing an anchorage line 23 of the invention, with the extremity of the anchorage line 23 being connected via a chain 61 with a conventional chain link structure to a drill-foundation pile 60 fixed to the bottom of the sea 62.

The chain has been constituted and deployed by using the barge 51 implemented in the mode of of FIG. 8. The anchorage line 23 is assembled from the barge 51 and then is connected to the pile 60, and finally the barge 51, via its crane 52, ensures the linking of the upper extremity of the line 23 to the floating vehicle where it is desired to carry out the anchorage, for example, a semi-submergible platform or a buoy.

Figure 11:
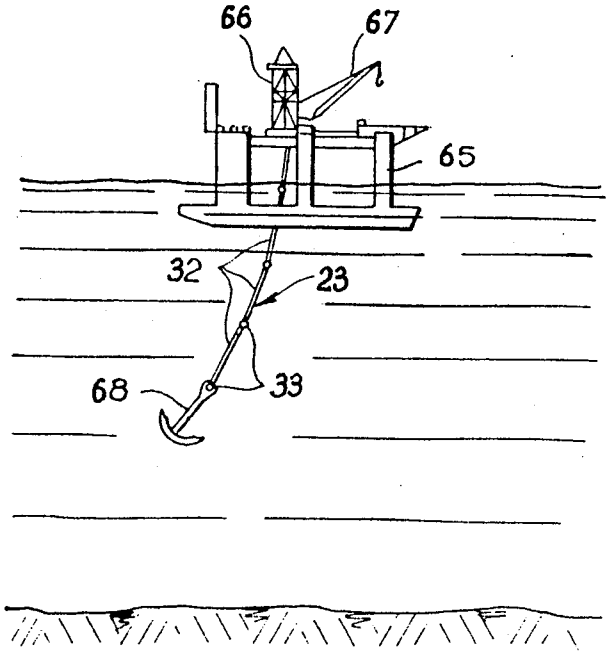

FIG. 11 shows a third mode of embodiment for implementing an anchorage line 23 of the invention wherein a dynamically positioned drilling platform 65 carries a rig or derrick 66 and a loading crane. Several tens of elements intended to constitute the anchorage line 23, namely, the tubular segments or elements 2 or 32 and the joint or articulation devices 3 or 33 have been previously stored on the platform 65.

The exploitation and handling devices mentioned are used to effect the assembly and deployment of the anchorage line 23 to the extremity from which fixed is a marine anchor 68. When the anchorage line 23 reaches a sufficient length longer than the water depth to the level of the platform 65, the anchor 68 secures the platform to the sea bottom.

Figure 12:
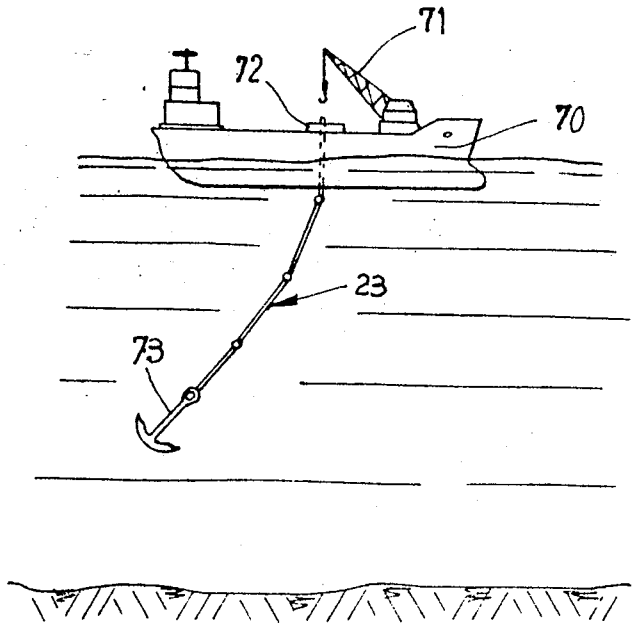

FIG. 12 shows a fourth mode for implementing and using an anchorage line 23 as claimed in the invention. The anchorage line 23 is assembled and deployed from an oil storage tanker 70. Handling and assembly devices 71 and 72, secured to the superstructure of the oil tanker, enable the anchorage line 23 to be assembled element by element, as in the previous cases.

A marine anchor 73 allows for anchorage of the oil tanker 70 when the anchorage line 23 has reached a sufficient length.

In the implementation case according to one of FIGS. 11 and 12, it is quite clear that it is possible to secure the extremity of the anchorage line 23 to a drill-foundation pile 60 shown in FIG. 10 instead of carrying out anchorage from a marine anchor.

The anchorage line as the invention is highly efficient, simple to construct and low in cost. Moreover, production and implementation of the anchorage line may be effected via simple operations by using current oil exploitation and drilling equipment.

The mechanical resistance and buoyancy characteristics of the anchorage line can easily be adapted to each particular case and the total length of the anchorage line, by virtue of its modular design and the compensation of its weight by means of buoyancy, can be brought to an extremely high value, greater than what is the case for all currently known anchorage lines. This length could, for example, be between 4000 and 10,000 meters.

The invention is not limited to the above-described embodiments and, possible to envisage any law of variation concerning the buoyancy of the anchorage line according to its length depending on the desired results.

It is possible to use sections of any length which are larger or smaller than those lengths mentioned above. It is also possible to use any linking device articulated between the tubular elements of the anchorage line from the time these linking devices can be easily assembled in accordance with existing exploitation conditions.

It is possible to envisage the embodiment of an anchorage line, not only by assembling end-to-end the tubular elements of the invention, but even by spatially disposing such essential elements and by connecting them by the anchorage line sections in accordance with the prior art.

Finally, the anchorage line of the invention may be used in fields other than research and oil exploitation.

What is claimed is:

1. A catenary anchorage line for a floating vehicle, the catenary anchorage line comprising a large number of successive articulatingly connected watertight tubular means closed at each end thereof and delimiting an interior volume filled with air, the anchorage line terminating at a first end at a shallow depth for linkage with the floating vehicle and a second end at a greater depth than said first end for insuring anchorage on a sea bottom, wherein a buoyancy of the anchorage line varies according to a length thereof, with the tubular means having a larger wall thickness relative to a diameter thereof then a wall thickness of the tubular means closer to the first end of the anchorage line.

2. An anchorage line as claimed in claim 1, wherein each of the tubular means have a constant buoyancy.

3. An anchorage line as claimed in claim 1, wherein each of the tubular means has a length of between 9 and 12 meters.

4. An anchorage line as claimed in claim 3, wherein said tubular means includes tubular elements used in research and oil exploration.

5. An anchorage line as claimed in one of claims 1, 2, 3 or 4, wherein the anchorage line has a length between the first end and second end thereof of between 4,000 and 10,000 meters.

6. An anchorage line as claimed in claim 4, wherein said tube means includes at least one of drill pipes, drill collars, and casing means.

7. An anchorage line as claimed in one of claims 1 or 2, wherein a catenary curve of the anchorage line varies continually from the second end of the anchorage line to the first end thereof.

8. An anchorage line as claimed in one of claims 1 or 2, wherein a curve of the catenary anchorage line is in a form of an S with two inflection points with the second end and the first end of the anchorage line being slightly inclined in relation to a horizontal.

9. An anchorage line as claimed in one of claims 1 or 2, wherein the tubular means at the second end of the anchorage line have a much heavier apparent weight in water than an apparent weight in water of the tubular means at the first end of the anchorage line.

10. A method for implementing an anchorage line as claimed in one of claims 1 or 2, the method comprising the steps of assembling the successive tubular means of the anchorage line on an operation site by articulated linking means, and lowering the tubular means into the water gradually during assembly by handling means.

11. A method as claimed in claim 10, applied to an anchorage of one of a research floating structure and subsea oil exploration structure, wherein the tubular means are lowered into the water by handling and assembling means equipping the respective structures.

* * * * *